US006017042A

United States Patent [19]

Paris

[11] Patent Number: 6,017,042

[45] Date of Patent: Jan. 25, 2000

[54] APPARATUS FOR RETAINING A BOOT ON A GLIDE BOARD

[75] Inventor: Jean-Francois Paris, Sevrier, France

[73] Assignee: Salomon S.A., Metz-Tessy, France

[21] Appl. No.: 08/868,939

[22] Filed: Jun. 4, 1997

[30] Foreign Application Priority Data

Jun. 6, 1996 [FR] France ..... 96 07259

[51] Int. Cl.[7] ..... B62B 9/04

[52] U.S. Cl. ..... 280/14.2; 280/619; 280/613; 280/623; 280/635; 36/117.1

[58] Field of Search ..... 280/619, 621, 280/622, 623, 624, 625, 633, 634, 635, 14.2; 36/117.1, 117.3

[56] References Cited

U.S. PATENT DOCUMENTS

| | | | |
|---|---|---|---|
| 2,154,019 | 4/1939 | Westphal | 280/619 |
| 2,338,249 | 1/1944 | Jansen | 280/624 |
| 2,554,706 | 5/1951 | Johansen | 280/619 |
| 3,888,497 | 6/1975 | Zahradka | 280/624 |
| 4,498,685 | 2/1985 | Zoor | 280/605 |
| 4,505,493 | 3/1985 | Gustavsson | 280/617 |
| 4,973,073 | 11/1990 | Raines et al. | 280/624 |
| 5,035,443 | 7/1991 | Kincheloe | 280/14.2 |
| 5,299,823 | 4/1994 | Glaser | 280/625 |
| 5,577,757 | 11/1996 | Riepl et al. | 280/624 |
| 5,692,765 | 12/1997 | Laughlin | 280/619 |
| 5,697,631 | 12/1997 | Ratzek et al. | 280/613 |

FOREIGN PATENT DOCUMENTS

| | | |
|---|---|---|
| 0680775 | 11/1995 | European Pat. Off. . |
| 2654591 | 5/1991 | France . |
| 9311717 | 12/1993 | Germany . |
| 4311630 | 8/1994 | Germany . |
| WO80/00063 | 1/1980 | WIPO . |
| WO90/11109 | 10/1990 | WIPO . |

*Primary Examiner*—Lanna Mai
*Assistant Examiner*—James S. McClellan
*Attorney, Agent, or Firm*—Greenblum & Bernstein, P.L.C.

[57] ABSTRACT

An apparatus for retaining a boot on a glide plate especially adapted for snowboarding, the boot including an upper affixed to a sole adapted to cooperate with the board. The apparatus includes a longitudinal positioning and retention device for the boot thereupon, such device being obtained in a complementary manner in a front lateral zone and a rear lateral zone and in the corresponding zones of the sole. Also, the transverse axes of the front and rear retention devices are spaced apart by a distance that is common to at least two boot sizes, enabling the length of the boot to be released and allowing the front and rear ends of the boot to be freed of all retention elements with respect to the board, such elements extending exclusively in a lateral direction with respect to the sole.

40 Claims, 5 Drawing Sheets

APPARATUS FOR RETAINING A BOOT ON A GLIDE BOARD

BACKGROUND OF THE INVENTION

1. Field of the Invention

The present invention is related to an apparatus for retaining a boot on a glide board especially adapted to snowboarding, the boot comprising an upper that is affixed to a sole adapted to cooperate with the board.

2. Description of Background Information

To date, the above-mentioned type of equipment could broadly be divided into two categories:

equipment that uses rigid boots attached to the board by a system of front and rear stirrups, and whose latching control is located on the rear stirrup which can be activated either manually or automatically; and equipment that uses flexible boots that are inserted into a shell fixed to the board, such shell comprising a certain number of straps adapted to affix the boot and the shell.

The disadvantage of rigid boots lies mainly in the fact that they do not allow a certain slack that is essential to the sport of snowboarding (lateral rigidity, front bending, asymmetrical behavior), and the comfort factor is also very arbitrary due to their design and the materials used.

In addition, the walking function is not efficient, whereas this is a function that is especially necessary and useful to a snowboarder.

Another disadvantage lies in the fact that the very substantial length of the boot, which is caused by the front and rear projections of the sole that are necessary for gripping the stirrups, results in the ends of the sole of the boot spilling over with respect to the snowboard.

As regards the boots of the second category, the disadvantages lie in the fact that putting on the boot and adjusting the strips is a long and painstaking process, the complementary arrangement of the flexible boot with the rigid shells is unsatisfactory, the shells present an inordinately cumbersome volume on the board, and comfort is inversely proportionate to the good retention of the foot.

In fact, the main advantage of flexible boots lies in the fact that they are essentially comfortable when not being used for snowboarding.

It was on the basis of these observations that the U.S. Pat. No. 5,299,823 described a solution wherein a rigid insert is arranged in the sole, more or less extending between the calcaneum and the metatarsal joint. The disadvantage of such an insert lies in the fact that it stiffens the sole of the boot to an unacceptable degree, whereas such boot claimed to be flexible for the reasons cited hereinabove.

As such, walking with these boots is an uncomfortable as it is with rigid boots.

In regards to the binding itself, the patents FR 2,654,591 and DE 4,311,630 describe the use of latching fingers that come out laterally from the sole and that act both as support and retention members. They use a releasable gripping system originating from the gliding device, and this makes the system both complicated and expensive. One disadvantage linked to these devices lies in the fact that since the sole of the boot functions as the support element on the board, the predetermined distance between the latching finger and the support zone can be disturbed due to wear and tear, or by a wedge of snow that could form under the sole. It is obvious that is such cases it would become impossible to guarantee the fitting of the fingers into the attachment element originating from the board. Further, since the retractable finger functions both as the support and retention elements, it becomes difficult for it to slide freely and correctly into its housing under certain circumstances of use, and in such a case, it would become necessary to oversize the strength of the return springs. In addition, the substantial amounts of energy generated just prior to jumps, for example, will rapidly deteriorate the finger and its housing.

SUMMARY OF THE INVENTION

An object of the invention is to overcome the latter-mentioned disadvantage characteristic of certain known apparatuses. That is, in accordance with an inventive step regarding one of the characteristics of the invention, it was envisioned that the retention function should be dissociated from the support function of the boot on the board, in order to avoid the problem that has just been cited hereinabove.

It is also an object of the present invention to overcome the other above-cited disadvantages by suggesting a retention apparatus that allows the use of a relatively flexible boot, but one that is stiffened by means of retention elements that are rigid and affixed to the board, and thus independent of the boot. Consequently, the boot remains flexible while walking.

It is also an object of the invention to resolve another problem that lies in the fact that generally boot sizes are associated to specific retention apparatuses that are adapted to fit each particular boot size.

In a way that resolves all of these problems, the invention is related to an apparatus for retaining a boot on a glide board especially adapted to snowboarding, the boot comprising an upper that is affixed to a sole which is adapted to cooperate with the board, characterized in that it is constituted by a longitudinal positioning and retention device for the boot thereupon, such device being obtained in a complementary manner in a lateral front zone and in a lateral rear zone of the device, on the one hand, and in corresponding zones of the sole, on the other hand.

The device is also characterized in that the transverse axes of the front and rear retention devices are spaced apart by a distance that is common to at least two boot sizes, thus allowing one to release entirely from the cradle, and allowing the front and rear ends of the boot to be free from all the retention elements with respect to board, such retention elements extending exclusively along a lateral direction with respect to the sole.

It is also known that in an athletic sport such as snowboarding, the boot requires a certain lateral slack with respect to the board.

The invention also aims to obtain this slack by virtue of means that are compatible with the retention device characterized hereinabove.

This is how other characteristics will become apparent from the following description, and these should be considered separately as well as in all possible technical combinations thereof.

BRIEF DESCRIPTION OF THE DRAWINGS

This description, which is provided as a non-limiting example, will lead to a better understanding of how the invention can be obtained with reference to the annexed drawings wherein.

DETAILED DESCRIPTION OF THE PREFERRED EMBODIMENTS

Figure 1:
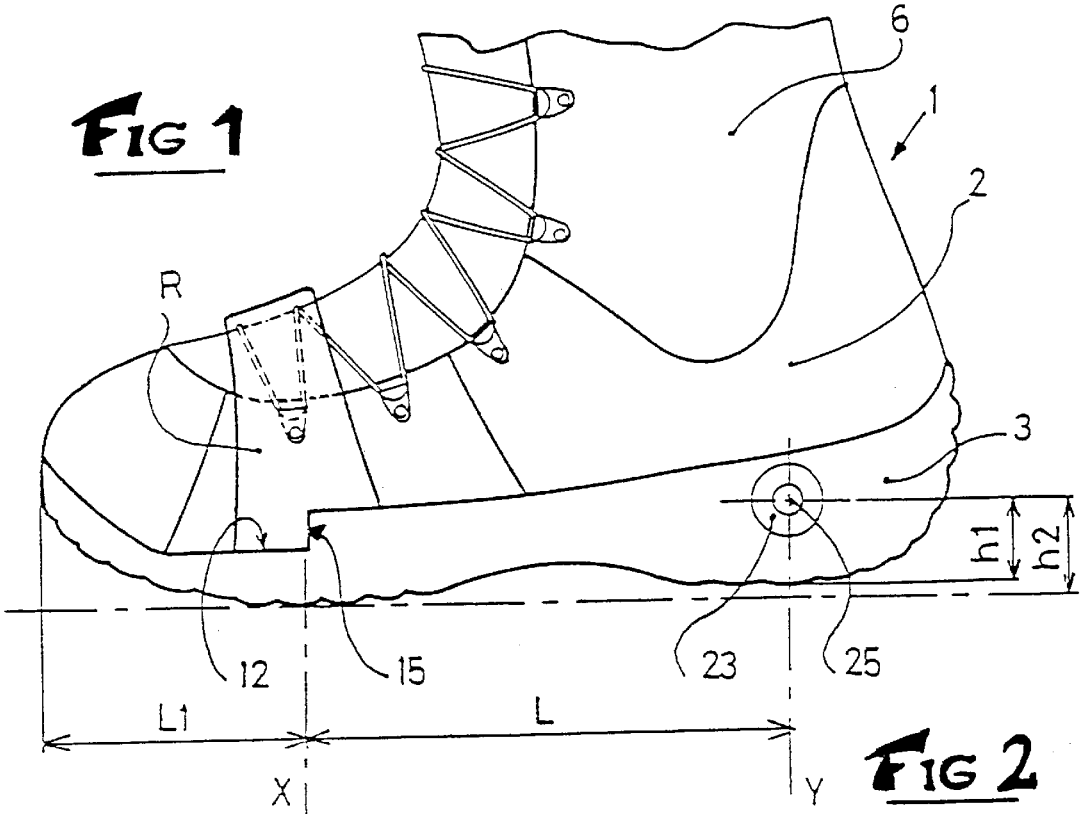
FIG. 1 is a side view of a boot illustrating a part of the retention apparatus as per the invention.
Figure 2:
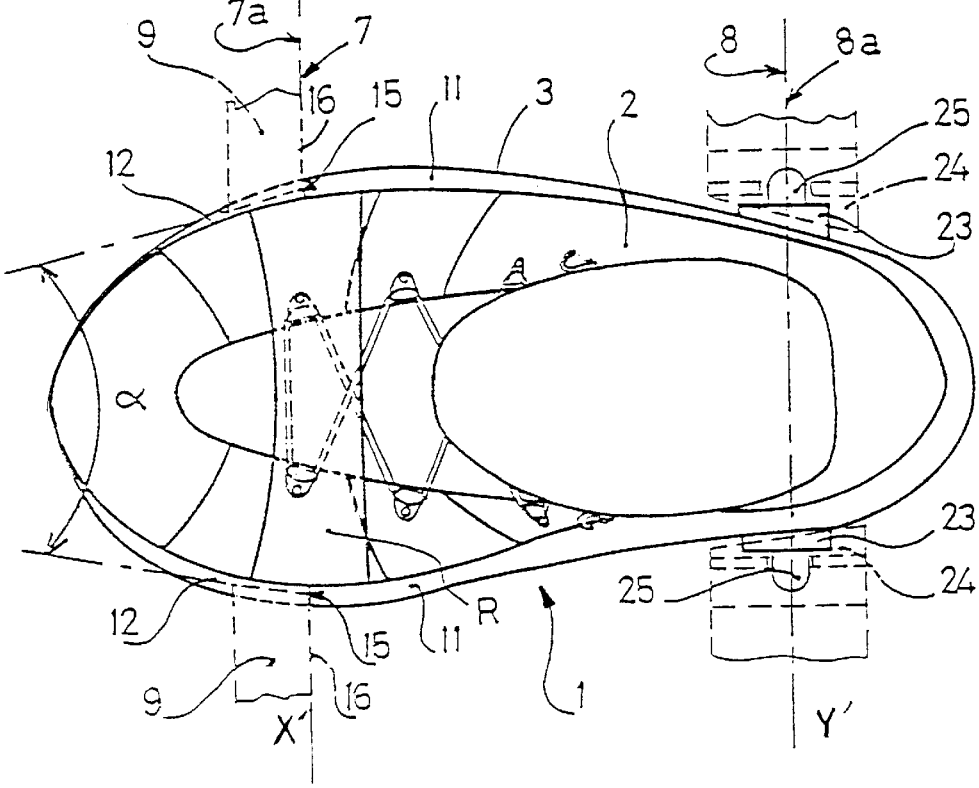
FIG. 2 is a top view as per FIG. 1, that schematically illustrates the complementary binding assembly of the board.

The boot 1 represented in FIG. 1 and 2, is constituted of an upper 6 and a flexible base 2 comprising a sole 3 adapted to be fixed on a glide board 4 via a retention apparatus constituted, as per the instant example, of an intermediate rigid cradle 5, located between sole 3 of boot 1 and the board 4, and comprising longitudinal positioning and retention devices for boot 1 thereupon, such devices being obtained in a complementary manner in a lateral front zone 7 and a lateral rear zone 8 of cradle 5 on the one hand, and in the corresponding zones 7A and 8A of sole 3 on the other hand.

The transverse axes XX' and YY' of the front retention device 7, 7A and rear retention device 8, 8A both of the cradle 5 and of sole 3 are spaced apart by a standard distance L, capable of allowing one to release entirely from the cradle, regardless of the size of boot 1 in any given range and, consequently, freeing the front and rear ends of the boot 1 of all retention elements with respect to the board 4, such retention elements extending exclusively along a lateral direction with respect to the sole 3.

The structure of the sole 3 is defined along a central, less deformable zone L that extends between the above cited transverse axes X,X' and Y,Y', and a relatively flexible zone L1, adapted to facilitate walking, and extending between the front end of the sole 3 and the front transverse axis X,X'.

Preferably, the front 7, 7A and rear 8, 8A retention and positioning devices are respectively located at the level of the metatarsus of the user's foot and his calcaneum.

Figure 4:
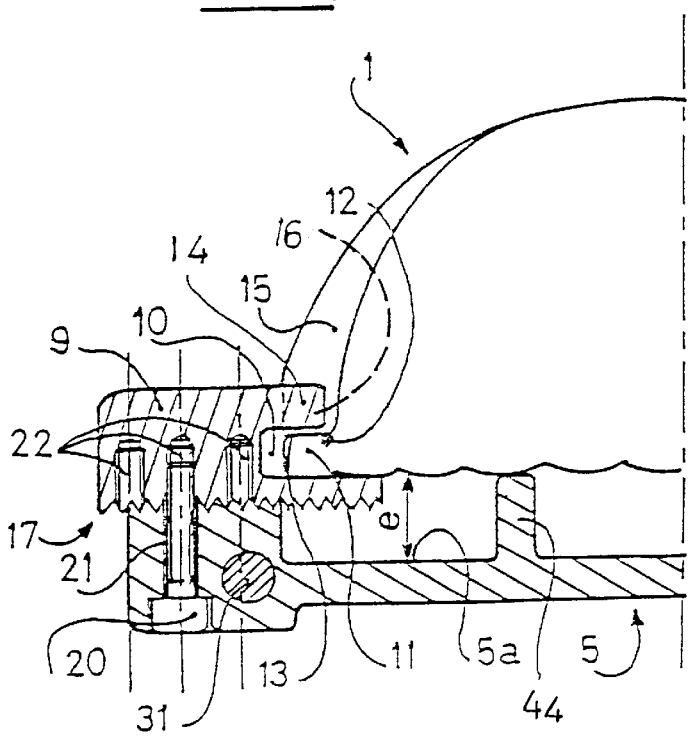
FIG. 4 is a transverse, partial sectional front view of the receiving cradle and of its retention device located in the zone of the metatarsus.

As can be seen in FIG. 4, the front retention and positioning device 7, 7A of boot 3 is constituted by two lateral slides 9 affixed to cradle 5 which demarcate the housings 10 whose sections correspond substantially with the lateral extensions 11 of sole 3, so that the upper edges 12 of the extensions 11 cooperate in vertical retention with the support surfaces 13 of the two horizontal arms 14 that form the slides 9. The upper edge 12 of the sole also forms a vertical abutment 15 that engages boot 1 longitudinally against the vertical end stops 16 of the slides 9, the vertical plane of the abutment 15 of the sole 3 constituting one of the references of distance L with respect to which the rear retention and positioning device 8, 8A.

The engagement of the boot is facilitated by the triangular shape of the sole 3 (angle $\alpha$), shown in FIG. 2.

This is facilitated even further by the fact that the introduction zone for the lateral slides 9 are inclined in a horizontal plane in such a way as to encourage the proper positioning of the front of boot 1 at the moment that is fastened to the board 4.

On the other hand, as can be seen in FIGS. 1 and 2, a reinforced zone R that has limited extensibility at least partially surrounds a journal perimeter of the boot substantially at the level of the upper edges 12 of the extensions 11 of sole 3. In this way, if the forefoot is raised in case of a front-to-rear rocking, the user can perceive it and efficiently control it.

Further, as can be seen for one side of the cradle in FIG. 4, the front lateral slide 9 is attached onto the cradle 5 by means of fastening device 17 that can be adjusted transversely so that is can be adapted to several sole 3 widths of boot 1. The opposite side of the cradle likewise includes a transversely adjustable fastening device.

As an example, the transverse adjustment device 17 of each of the lateral slides 9 are constituted by a screw 20 that crosses the base 5*a* of the cradle 5 via a passage hole 21, and is capable of cooperating with one of a plurality of threaded holes 22.

As has also been illustrated in FIG. 4, the slides 9 are raised with respect to the base 5*a* of the cradle 5 so as to free up a space e between the cradle and the sole 3 of boot 1, which enables it to tolerate a wedge of snow that may have formed beneath the sole 3.

It is also possible to envision studs 44 supporting the boot in a zone located between the lateral slides 9 in order to avoid it from getting bent in a localized manner.

Designed in this manner, boot 1 is extremely easy to use. Indeed, all that one needs to do is to engage the end of boot 1 into slides 9, until abutment 15 of the boot comes into contact with the vertical abutment 16 of the slide 9, and then to lower the heel of the boot 3, which automatically gets latched into the complementary rear retention device 8, 8A of the boot 3 and of the cradle 5.

These rear retention and positioning device 8, 8A of boot 1 are dissociated from the front retention and positioning device 7, 7A and are constituted of lateral support members and latching members that are also dissociated and that cooperate with the corresponding portions of cradle 5, the portions being obtained on the lateral flanks 5*b* thereof.

As has been illustrated in FIGS. 1, 2, 3 and 5, the rear support members of boot 3 are constituted by lateral studs 23 that are arranged on sole 3 at the level of the heel and cooperate in vertical support with supports having a corresponding shape 24 that are obtained on the inner faces of the lateral flanks 5*b* of cradle 5.

These studs 23 are preferably cylindrical for ease of manufacture and are positioned in the corresponding seats of the supports 24 of cradle 5.

They can also be made of an elastomer, thus also providing them with a shock absorption function.

In addition, the latching members are pins 25 that are arranged in a concentric manner within each lateral support stud 23 and are capable of cooperating with the corresponding housings 26 that are also concentric and obtained at the base of the corresponding supports 24 of cradle 5.

Figure 5:
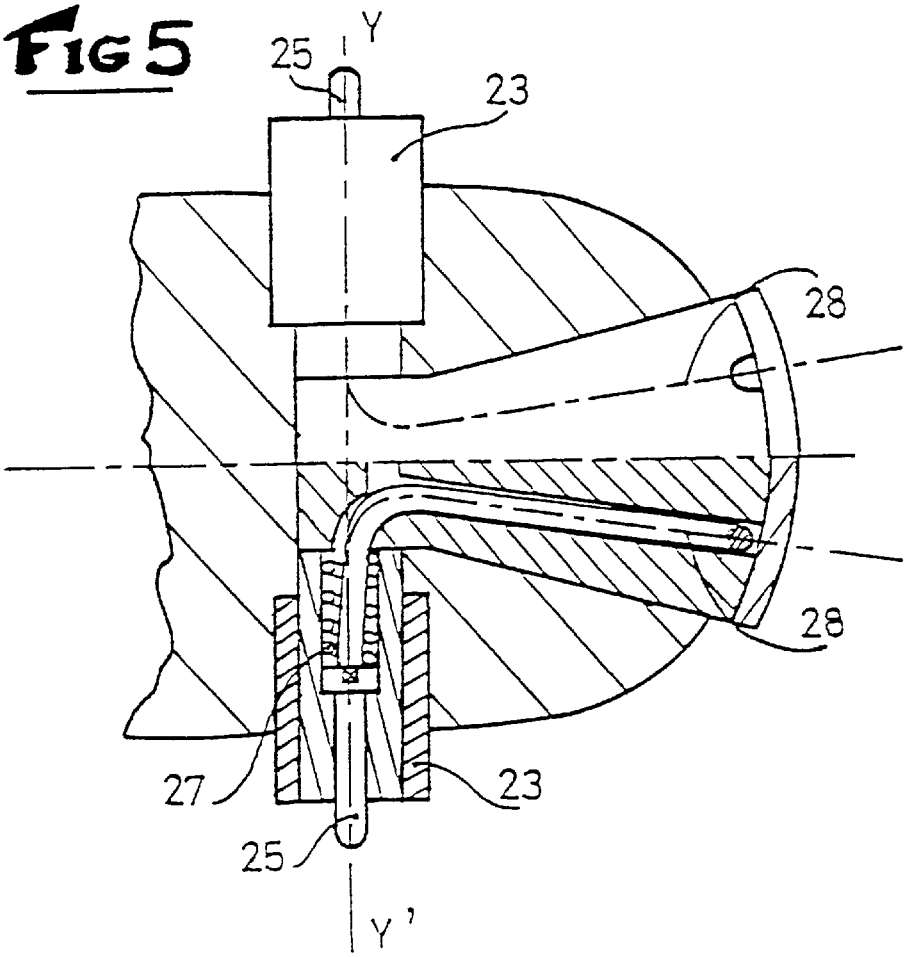
FIG. 5 is a partial sectional view of the rear retention device associated to an activation element.
Figure 8:
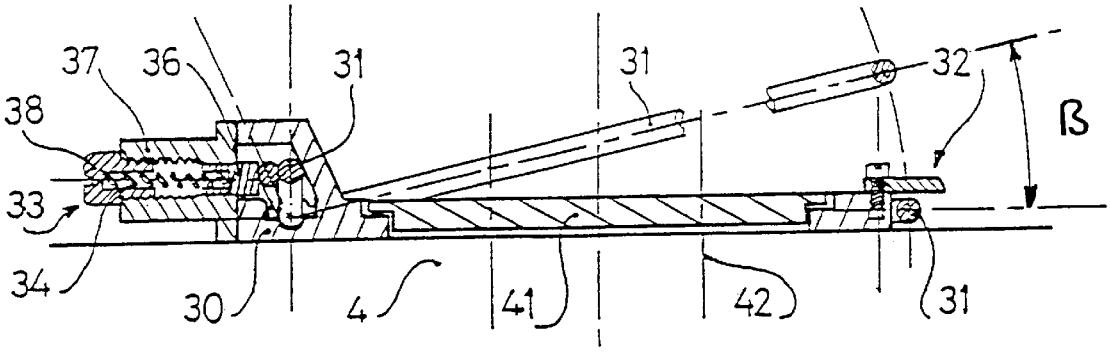
FIG. 8 is a longitudinal sectional view of the connection device as per FIG. 7.

As can be seen particularly well from FIG. 5, the latching pins 25 are capable of clicking together elastically in the corresponding housings 26 of cradle 5 by virtue of thrusting mechanisms 27, that are elastically deformable in compression during the descent of the heel of boot 1 towards the cradle 5, until the pins 25 find themselves across from their respective housings 26 and become introduced therein, the activation occurring via a traction operation on the pins 25 against the elastic members 27.

Figure 3:
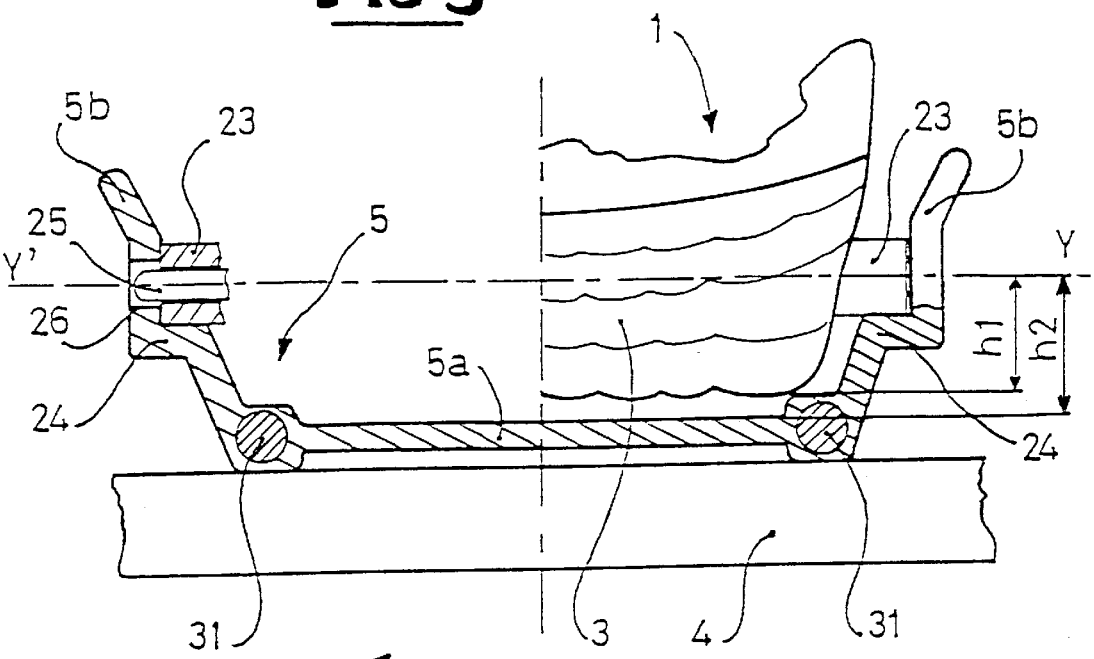
FIG. 3 is a transverse, sectional rear view of a receiving cradle of the boot and of its retention device in the spade zone, with and without the boot.

According to another characteristic of the invention as illustrated in FIGS. 1 and 3, the transverse axis Y,Y' of the rear support and lateral latching members 23, 24 and 25, 26 of the cradle with respect to its base 5*a* is located at a distance having a value h2 that is greater than the value h1 that separates the corresponding axis of the boot 1 from the plane of sole 3 so as to be able to avoid a possible wedge of snow at the heel.

Figure 6:
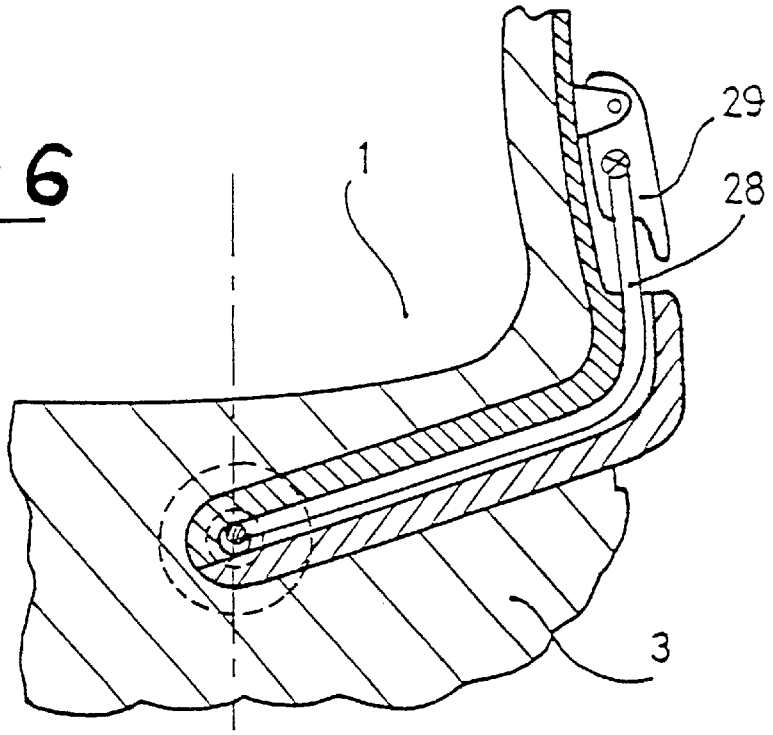
FIG. 6 is a sectional view of a control lever of the activation element.

As is also shown in FIGS. 5 and 6, the pins 25 are connected to the activation mechanism that is constituted by two traction cables 28 that are affixed to each of the inner ends of the pins 25 and connected to each other by means of a single control lever 29 fixedly located on a rear portion of boot 1.

The lever 29 can have a stable opening position that enables the pins to be retracted, while walking, and therefore, to remain safe from shocks and other aggressive actions.

In an embodiment variation, the cable 28 can be connected to a control system other than the lever 29 journaled on the boot, for example, a flexible link transporting the control point towards the size of the user so as to be able to allow activation while "standing". The construction illustrated in FIGS. 5 and 6 is therefore not limiting in nature and any other construction that dissociates the boot support element on the support element originating from the glide board from the latching retention element on the support element would remain within the scope of the invention.

Figure 7:
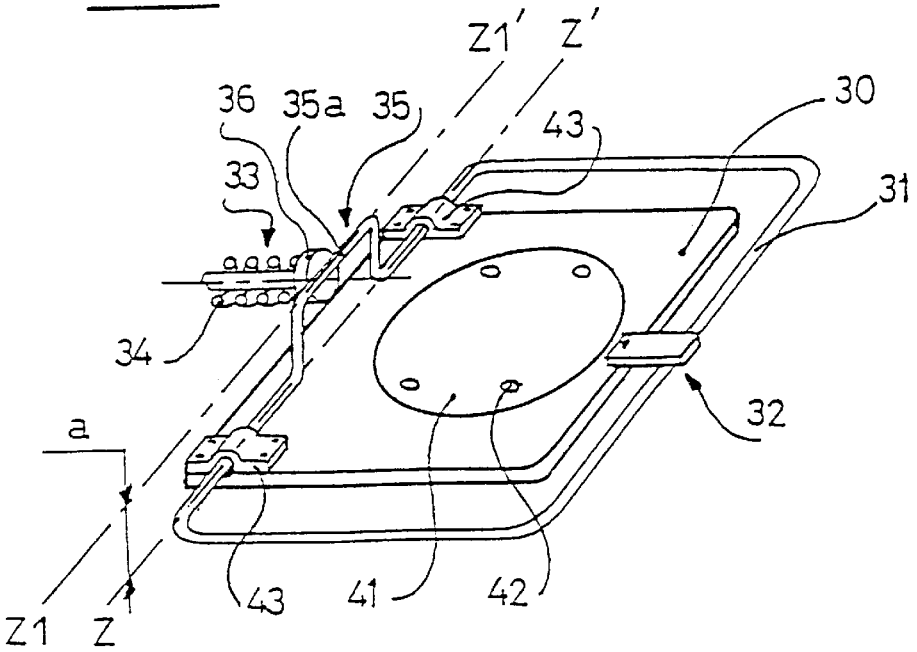
FIG. 7 is a schematic, perspective view of the connecting device of the cradle on the board.

According to another characteristic of the invention as illustrated in FIG. 7, the receiving cradle 5 of boot 1 is itself fixed to the board by means of a plate 30 on which a frame 31, journaled angularly, is affixed to cradle 5 along an inner lateral longitudinal axis Z,Z' of the plate 30.

The longitudinal axis ZZ' corresponds substantially to the inner flank of the foot.

As can also be sen from FIG. 7, the journaled frame 31 is constituted by a filamentary member that is shaped overall as per the contour of the cradle 5 in the lateral lower and end edges of which the frame 31 is buried, except in some lateral journal zones with respect to the binding plate 30 on board 4.

The journal of frame 31 is undertaken by means of hinges 43 that are affixed to plate 30. The cradle 5 and its journal frame 31 comprise an effective latching mechanism 32 with respect to the binding plate 30 on board 4.

In addition, the cradle 5 and its journal frame 31 comprise an arrangement for adjusting the clearance angle β around the axis ZZ', that are associated, as per the instant example, to elastic return element 33 that allow the inclination of the cradle 5 to be limited, and that provide a certain slack in the lateral bending of boot 1. The elastic return element 33 of cradle 5 and of its frame 31 are constituted by a thrusting mechanism 34 that acts against an extension 35 of frame 31 extending along a perpendicular plane with respect to the plane thereof.

This extension is schematically constituted of a "U" that is obtained by the continuous shaping of the same steel wire forming the frame 5.

The horizontal arm 35*a* thus constitutes a second longitudinal axis Z1, Z1' that is parallel to the first Z, Z' and is displaced coaxially with respect to the latter in order to act as a cam and function against a piston 36 that is elastically returned by spring 34.

The piston 36—spring 34 assembly is housed and guided in a casing 37 that is affixed to plate 30. It is well understood that when the cradle 5 becomes stressed rotationally about the axis Z, Z', a simple and efficient energization is obtained, by virtue of the distance "a" between the axes Z,Z' and Z1, Z1', and the piston-spring system, which is even more easy to adjust thanks to a mobile abutment 38 that more or less pre-stresses the spring.

The addition of an adjustable abutment could, if so desired, limit the displacement of the axis Z', Z1', and thus the angle of rotation β of frame 31, and this can be done independently of the strength of spring 34.

In addition, for some sporting practices, it may be desirable that this amplitude be reduced to zero.

In such a case, all one needs is a latch 32 fixed to the plate 30 and blocking the rotation of frame 31. The latch 32 can have two positions, one in which it is active and the other in which it is inactive.

Figure 10:
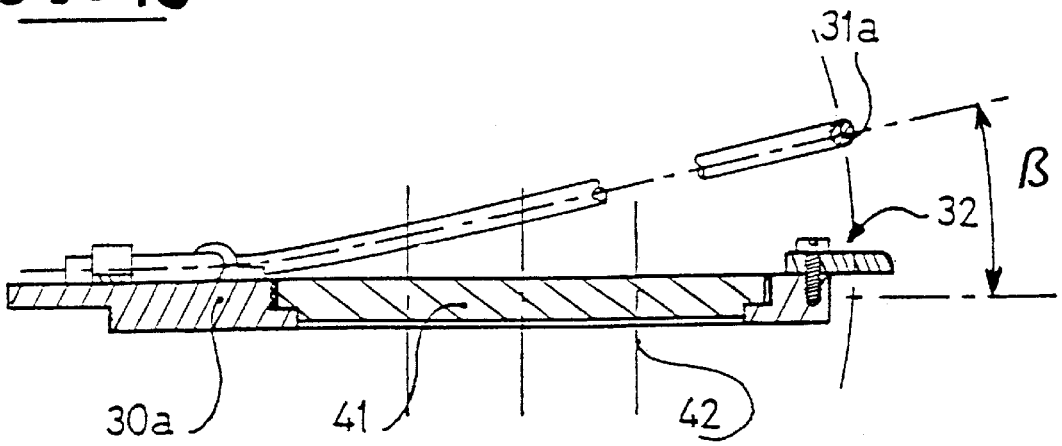
FIG. 10 is a longitudinal sectional view of the connecting device according to FIG. 9.
Figure 9:
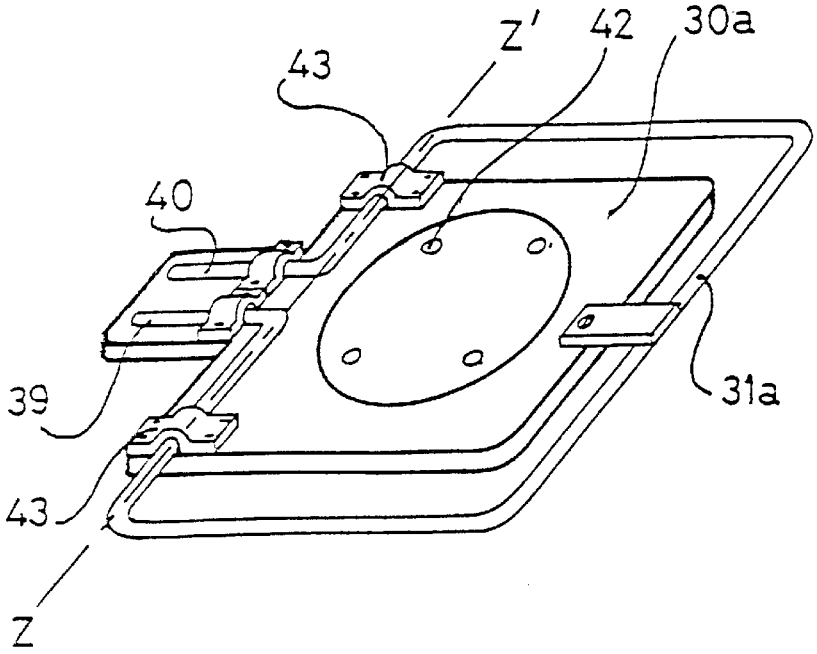
FIG. 9 is a schematic, perspective view of the connecting device of the cradle on the board, as per an embodiment variation.

In circumstances where adjustment of the energization is not considered absolutely essential, FIGS. 9 and 10 represent another energization mode for frame 31, that is simpler but more difficult to adjust.

Here too, the rounded wire is folded so as to form arms 39, 40 along the axis Z, Z'. The axis Z, Z' thus becomes a torsional axis, energizing the rotation of frame 31, and thus of the cradle 5 in which it is buried.

The extensions 39, 40 are constituted by two free ends of the frame 31*a* that extend laterally towards the outside in the same plane in order to form the torsion bars.

According to another characteristic of the invention, the plate 30, 30*a* is fixed to the board 4 by means of a base 41 constituting a rotational pivot for the plate 30, 30*a* in order to obtain an angular variation thereof during loosening of the base 41 and its immobilization in position when it is being re-tightened.

This is obtained by means of immobilization screws 42 of the pivot 41 on plate 30 by pressing it against the board 4.

Although the invention has been described with reference to particular means, materials, and embodiments, it is to be understood that the invention is not limited to the particulars expressly disclosed, but the invention extends to all equivalents within the scope of the claims that follow.

The instant application is based upon the French Priority Patent Application No. 96 07259, filed on Jun. 6, 1996, the disclosure of which is hereby expressly incorporated by reference thereto, and the priority of which is hereby claimed under 35 U.S.C. §119.

What is claimed is:

1. An apparatus for retaining a boot on a glide board adapted for snowboarding to which the apparatus is secured, the boot including an upper affixed to a sole, the apparatus comprising:

a front longitudinal positioning and retention device including a pair of front lateral engaging portions formed in a front lateral zone of the apparatus: and a rear longitudinal positioning and retention device including a pair of rear lateral engaging portions formed in a rear lateral zone of the apparatus, said rear lateral engaging portions of said rear longitudinal positioning and retention device being longitudinally separated from said front lateral engaging portions of said front longitudinal positioning and retention device, said pairs of front and rear lateral engaging portions being positioned in a four-point arrangement adapted to laterally engage retain and longitudinally position complementary pairs of front and rear lateral engaging portions formed in lateral sides of the sole of the boot at four points so that the sole of the boot is not retained by said apparatus over the longitudinal separation between said front and rear lateral zones and between lateral sides of the sole of the boot.

2. An apparatus according to claim 1, further comprising:

support structure providing a vertical support function for the boot;

said pair of front lateral engaging portions and said pair of rear lateral engaging portions provide a retention function for the boot, said retention function being dissociated from said support function.

3. An apparatus according to claim 2, wherein:

a rigid cradle is positioned for receiving the boot thereon, said cradle being intermediate between the boot and the glide board, said cradle comprising a part of said support structure to vertically support the boot; and said pair of rear lateral engaging portions comprises lateral latching members.

4. An apparatus according to claim 3, wherein:

said support structure further comprises lateral support studs to be affixed on opposite lateral sides of the sole of the boot to engage said cradle; and said lateral latching members comprise latching pins positioned for sliding within respective ones of said lateral support studs, respective elastic members being positioned to elastically bias said latching pins laterally for engagement with said cradle.

5. An apparatus according to claim 1, wherein:

said pair of front lateral engaging portions comprises a pair of laterally opposed positioning and retention front elements adapted to engage and longitudinally position respective opposite sides of the boot, said front elements extending along a forward transverse axis;

said pair of rear lateral engaging portions comprises a pair of laterally opposed positioning and retention rear elements adapted to engage and longitudinally position respective opposite sides of the boot, said rear elements extending along a rear transverse axis;

said front and rear transverse axes are spaced apart by a distance that is identical for at least two boot sizes, there being no boot-retention structure for front and rear ends of the boot.

6. An apparatus according to claim 1, wherein:

said pair of front lateral engaging portions is arranged in an area of the metatarsus of the user's foot and said pair of rear lateral engaging portions is arranged in an area of the calcaneum of the user's foot.

7. An apparatus according to claim 1 in combination with the boot, wherein:

a portion of the sole of the boot forward of said pair of front lateral engaging portions, when the boot is engaged and positioned by said pair of front lateral engaging portions, is relatively flexible to facilitate walking.

8. An apparatus and boot according to claim 7, wherein:

a portion of the sole of the boot between said pair of front lateral engaging portions and said pair of rear lateral engaging portions, when the boot is engaged and positioned by said front and rear longitudinal positioning and retaining devices, is relatively less flexible than said portion of the sole forward of said pair of front lateral engaging portions.

9. An apparatus according to claim 1, wherein:

said pair of front lateral engaging portions comprises two lateral slides, said slides comprising horizontal arms demarcating housings having sections corresponding substantially to lateral extensions of the sole of the boot, such that upper edges of the extensions cooperate in vertical retention with the support surfaces of said horizontal arms, the sole having an upper edge forming a vertical abutment acting in the direction of the longitudinal engagement of the boot against vertical end stops of said slides, the vertical plane of abutment of the sole extending along said front transverse axis.

10. An apparatus according to claim 9, wherein:

said lateral slides define boot introduction zones, said introduction zones being inclined along a horizontal plane to facilitate positioning of the front of the boot as the boot is inserted into the apparatus.

11. An apparatus according to claim 9, wherein:

each of said lateral slides comprises a transversely adjustable binding device for adapting to a plurality of sole widths of different boots.

12. An apparatus according to claim 11, wherein:

a rigid cradle is positioned for receiving the boot thereon, said cradle adapted to be positioned between the boot and the glide board;

said lateral slides are affixed to said cradle, said transversely adjustable binding device comprising a screw extending through a base of said cradle via a passage hole and being threaded into one of a plurality threaded holes.

13. An apparatus according to claim 11, wherein:

said lateral slides are raised with respect to a base of the cradle so as to create a space between said base and the sole of the boot, to accommodate a wedge of snow formed beneath the sole.

14. An apparatus according to claim 1, wherein:

a rigid cradle is positioned for receiving the boot thereon, said cradle adapted to be positioned between the boot and the glide board; and said rear longitudinal positioning and retention device is constituted by lateral support members and latching members, said support members and latching members being dissociated and cooperate with corresponding portions along lateral flanks of said cradle.

15. An apparatus according to claim 14, wherein:

said lateral support members of the boot are constituted by lateral support studs arranged on the sole in the area of the heel and cooperate in vertical support with supports of complementary shapes provided on inner lateral flanks of said cradle.

16. An apparatus according to claim 14, wherein:

each of said latching members is a latching pin arranged in a concentric manner within a respective one of said lateral support studs and cooperates with a corresponding housing, each said corresponding housing also being concentric and formed at a base of respective supports of said cradle.

17. An apparatus according to claim 16, wherein:

elastic thrusting elements are positioned for exerting an elastic force against respective ones of said latching pins for movement of said latching pins in a direction toward and insertion into respective ones of said housings.

18. An apparatus according to claim 14 in combination with the boot, wherein:

said lateral support members and said latching members extend along a transverse axis, said transverse axis being spaced from a horizontally extending base of said cradle by a distance, said distance being greater than a distance between said transverse axis and a lower surface of the sole of the boot to accommodate a possibility of snow beneath the heel of the boot.

19. An apparatus according to claim 17 in combination with the boot, wherein:

an activation device constituted by two traction cables are affixed to respective inner ends of said latching pins and are connected to each other by a single control lever, said control lever is fixedly arranged on a rear portion of the boot.

20. An apparatus according to claim 1, further comprising:

a rigid cradle positioned for receiving the boot thereon, said cradle being adapted to be positioned between the boot and the glide board;

a frame and a journal for journalling said frame with respect to the glide board along an inner lateral longitudinal axis; and a binding plate attached for movement with said frame, said cradle being affixed to said plate.

21. An apparatus according to claim 20, wherein:

said journalled frame is constituted by a filamentary member, said filamentary member generally conforming to a contour of said cradle, said frame being buried within lateral lower and end edges of said cradle, with the exception of certain lateral journal zones of said filamentary member with respect to said binding plate on the glide board.

22. An apparatus according to claim 20, wherein:

said cradle and said journalled frame comprise an effective latching device between said binding plate and said glide board.

23. An apparatus according to claim 22, wherein:

said cradle and said journalled frame additionally include an angular adjustment mechanism associated to said latching device.

24. An apparatus according to claim 20, wherein:

said cradle and said journalled frame additionally include an elastic return element for limiting an inclination of said cradle and for permitting a certain slack during the lateral bending of the boot.

25. An apparatus according to claim 24, wherein:

said elastic return element is constituted by an elastic thrusting mechanism acting against an extension of the frame extending in a perpendicular plane with respect to a plane of said frame.

26. An apparatus according to claim 25, wherein:

said elastic return element is constituted by extensions of two free ends of said frame extending laterally outwardly in said plane of said frame to form torsion bars.

27. An apparatus according to claim 20, wherein:

said plate is adapted to be attached to the glide board by means of a base constituting a rotational pivot for said plate for obtaining an angular positional adjustment by loosening the attachment of said base to the glide board, rotating said plate with respect to said plate, and tightening the attachment of said base to the glide board.

28. An apparatus according to claim 1, further comprising:

a reinforced zone at least partially surrounding a journal perimeter of the boot substantially in an area corresponding to the upper edges of the extensions of the sole.

29. A boot and an apparatus for retaining the boot on a snowboard to which the apparatus is secured, comprising:

a relatively flexible boot having a sole and an upper extending upwardly from said sole, said boot having a front end and a rear end, said sole having a front lateral zone and a rear lateral zone, and said sole including a pair of front lateral engaging portions formed in lateral sides of the front lateral zone and a pair of rear lateral engaging portions formed in lateral sides of the rear lateral zone;

an apparatus for cooperating exclusively with said lateral engaging portions of said boot said apparatus having a front lateral zone and a rear lateral zone complementary to those of said sole, and comprising:

a front longitudinal positioning and retention device, including a pair of front complementary lateral engaging portions formed in the front lateral zone of the apparatus; and a rear longitudinal positioning and retention device, including a pair of rear complementary lateral engaging portions formed in the rear lateral zone of the apparatus, said rear lateral engaging portions of said rear longitudinal positioning and retention device being longitudinally separated from said front lateral engaging portions of said front longitudinal positioning and retention device, said pairs of front and rear complementary lateral engaging portions of said apparatus being positioned in a four-point arrangement adapted to laterally engage, retain and longitudinally position said pairs of front and rear lateral engaging portions of the sole at four points, the sole being not retained by said apparatus over the longitudinal separation between said front and rear lateral zones of the apparatus or between said lateral sides of the sole of the boot.

30. A boot and apparatus according to claim 29, further comprising:

cradle having a support structure providing a vertical support function for said boot;

said pair of front lateral engaging portions and said pair of rear lateral engaging portions provide a retention function for said boot, said retention function being dissociated from said support function.

31. A boot and apparatus according to claim 29 in combination with a second boot, wherein:

said boots have different lengths;

said pair of front lateral engaging portions comprises a pair of laterally opposed positioning and retention front elements for engagement and longitudinally positioning of respective front lateral zones of said sole of either of said boots, said front elements extending along a forward transverse axis;

said pair of rear lateral engaging portions comprises a pair of laterally opposed positioning and retention rear elements for engagement and longitudinally positioning of respective rear lateral zones of said sole of either of said boots, said rear elements extending along a rear transverse axis;

said front and rear transverse axes are spaced apart by a determined distance that is identical for both of said boots.

32. A boot and apparatus according to claim 29, wherein:

said pair of front lateral engaging portions is arranged in an area of the metatarsus of the user's foot and said pair of front lateral engaging portions is arranged in an area of the calcaneum of the user's foot.

33. A boot and apparatus according to claim 29, wherein:

a portion of said sole of said boot forward of said pair of front lateral engaging portions, when the boot is engaged and positioned by said pair of front lateral engaging portions, is relatively flexible to facilitate walking.

34. A boot and apparatus according to claim 33, wherein:

a portion of said sole of said boot between said pair of front lateral engaging portions and said pair of front lateral engaging portions, when said boot is engaged and positioned by said front and rear longitudinal positioning and retention devices, is relatively less flexible than said portion of said sole forward of said pair of front lateral engaging portions.

35. A boot and apparatus according to claim 29, wherein:

said pair of front lateral engaging portions comprises two spaced apart lateral slides, said slides comprising horizontal arms demarcating housings having sections corresponding substantially to lateral extensions of said sole of said boot, such that upper edges of the extensions cooperate in vertical retention with the support surfaces of said horizontal arms, said sole having an upper edge forming a vertical abutment acting in the direction of the longitudinal engagement of said boot against vertical end stops of said slides, the vertical plane of abutment of said sole extending along said front transverse axis.

36. A boot and apparatus according to claim 35, wherein:

said spaced apart lateral slides extend in a longitudinally converging manner to define a boot introduction zone to facilitate positioning of the front of the boot as the boot is inserted into the apparatus.

37. A boot and apparatus according to claim 29, wherein:

a rigid cradle is positioned for receiving said boot thereon, said cradle adapted to be positioned between said boot and the glide board; and said rear longitudinal positioning and retention device is constituted by lateral support members and latching members, said support members and latching members being dissociated and cooperate with corresponding portions along lateral flanks of said cradle.

38. The boot and apparatus according to claim 29, the boot further comprising:

a reinforced zone at the upper side of the boot extending between said pair of front lateral engaging portions, for providing tactile feedback to the upper side of the foot during front to rear rocking.

39. An apparatus for retaining a boot on a glide board adapted for snowboarding to which the apparatus is secured, and for permitting step-in/step-out engagement of the boot to the apparatus, comprising:

a pair of front lateral engaging portions positioned on lateral sides of the apparatus and open toward a boot heel side of the apparatus;

a pair of rear lateral engaging portions positioned on lateral sides of the apparatus and open toward a boot bottom side of the apparatus; and a step-in lock provided to the rear lateral engaging portions, said front lateral engaging portions accepting, via longitudinal sliding, complementary engaging portions at a metatarsus area of the boot, and said rear lateral engaging portions accepting, via vertical stepping, complementary engaging portions at a calcaneum area of the boot, such that the apparatus provides lateral retention at said metatarsus and calcaneum areas of the boot but accepts a step-in of the boot to the apparatus in a longitudinal direction of the apparatus and the boot.

40. A boot and apparatus for retaining the boot on a glide board adapted for snowboarding to which the apparatus is secured, and for permitting step-in/step-out engagement of the boot to the apparatus, comprising:

a pair of front lateral engaging portions positioned on lateral sides of the apparatus and open toward a boot heel side of the apparatus;

complementary front engaging portions provided at a metatarsus area of the boot a pair of rear lateral engaging portions positioned on lateral sides of the apparatus and open toward a boot bottom side of the apparatus;

complementary rear engaging portions provided at a calcaneum area of the boot; and a step-in lock provided to the rear lateral engaging portions, said front lateral engaging portions accepting, via longitudinal sliding, the complementary front engaging portions of the boot, and said rear lateral engaging portions accepting, via vertical stepping, the complementary engaging portions of the boot, such that the apparatus provides lateral retention at said metatarsus and calcaneum areas of the boot but accepts a step-in of the boot to the apparatus in a longitudinal direction of the apparatus and the boot.

* * * * *